United States Patent [19]

Adams

[11] Patent Number: 4,465,590

[45] Date of Patent: Aug. 14, 1984

[54] PROCESS FOR ELIMINATING POLYCHLORINATED BI-PHENYLS FROM OILS

[75] Inventor: Edward C. Adams, Barto, Pa.

[73] Assignee: American Mobile Oil Purification Co., Inc., Lawrenceville, N.J.

[21] Appl. No.: 524,133

[22] Filed: Aug. 17, 1983

[51] Int. Cl.[3] ..... C10G 17/00

[52] U.S. Cl. ..... 208/262; 585/469

[58] Field of Search ..... 208/262; 585/469

[56] References Cited

U.S. PATENT DOCUMENTS 4,337,368 6/1982 Pytlewski et al. ..... 568/730

4,340,471 7/1982 Jordan ..... 210/101

4,377,471 3/1983 Brown ..... 208/262

4,379,752 4/1983 Norman ..... 210/712

*Primary Examiner*—Curtis R. Davis

*Attorney, Agent, or Firm*—Leonard Michael Quittner

[57] ABSTRACT

A process for eliminating by destruction polychlorinated bi-phenyls from hydrocarbonaceous oil contaminated therewith is disclosed. The oil is admixed with liquid sodium in an atmosphere of argon gas and allowed by refluxing, mixing, agitation, and hydrogenation circulation to react therewith. The polychlorinated bi-phenyls are eliminated, the reaction products are filtered and the uncontaminated treated oil is rendered susceptible to re-use.

13 Claims, 3 Drawing Figures

PROCESS FOR ELIMINATING POLYCHLORINATED BI-PHENYLS FROM OILS

BACKGROUND OF THE INVENTION

1. The Field of the Invention

The field of the invention relates to the purification of oils and more particularly the elimination of contaminant polychlorinated bi-phenyls (hereinafter "PCB's") from hydrocarbonaceous oils by the treatment of such oils with liquid sodium. Accordingly the general objects of the present invention are to provide a novel and improved method of such character.

2. Description of the Prior Art

The background art of the invention reveals various attempts at elimination and destruction of PCB's, highly toxic environmental polutants, from oil, and particularly transformer oil. Reference is made for this purpose to the Naphthalide Process of Goodyear Company, the Acutrex Process of Sohio Company, the Microfine Process and the efforts of one Robert Layman and Lynwood Kemp, employees or consultants to Life Enterprises, Inc. and The Chemical Decontamination Corporation, both Pennsylvania Corporations, in addition to others not presently identifiable by your applicant. These methods are generally characterized by reactions which attempt to strip away chlorine from the aromatic ring structure of the bi-phenyl leaving, inter alia, a non-chlorinated bi-phenyl, benzene, chloro-benzene and sodium chloride, some of which are themselves environmentally harmful. In addition, previous inventions have proven incapable of, or uneconomical in, reducing the level of PCB's or by creating other toxic contaminants. One of the basic problems encountered, which the present invention solves, has been the uncontrolled formation of undesirable free radicals occasioned by the presence of various addition products, including sodium, and a consequent polymerization or combination of such radicals into environmentally harmful products remaining in the oil. The objective of the present invention is to reduce PCB levels to below two (2) parts per million (hereinafter "ppm") as preferred and required by the Environmental Protection Agency (hereinafter "EPA") and without forming other contaminants before the oil is re-cycled for use as, for example, in transformers. A further object is to reduce large polymer by-products possible in the reaction simultaneously therewith by controlled hydrogenation of free radicals of bi-phenyl and other remnants of the destructive reaction process. Within recent date in the United States, at least fourteen million (14,000,000) metric tons of unuseable, nondisposable transformer oil containing PCB's remained untreated. As has been well-publicized the mere storage of oil-containing PCB's is in itself a severe, continuing threat to the environment and constitutes an uneconomical sequestration of capital by compelling the maintenance of such oils in static inventory and in special storage facilities.

The method disclosed in this application provides a cheap, rapid, indeed portable, means for reducing to acceptable levels, and at times in fact eliminating altogether, PCB's in oils.

SUMMARY OF THE INVENTION

The invention maybe summarized as a process in which transformer oil is first heated, under moderate vacuum and elevated temperature to separate by vacuum distillation water, solvents and light fraction oils and is then admixed and reacted with liquid sodium. Thereafter, in an environment of argon gas, the mixture is raised further in temperature and subjected to severe agitation forces by circulation through a specially designed rotary mixer and by the use of ultrasonic vibration. To accelerate the reaction, hydrogen gas is dissolved in the mixture by entrainment to suppress the formation of undesirable contaminants and polymers. In a very short period of time, chemical analysis reveals surprisingly the almost total elimination of PCB's from the treated oil or at least such a substantial reduction of them as to be at acceptable EPA levels. Thereupon the reactants are cooled, the treated oil filtered off and put safely back in use. The waste products, mostly sodium chloride and argon gas, are entirely acceptable to the environment and also ready for disposition. As will also appear some of the argon gas is re-usable in the ongoing process.

DESCRIPTION OF DRAWINGS

The present invention may be better understood and its numerous objects and advantages will become apparent to those skilled in the art by reference to the drawings wherein like reference numerals refer to like elements among the figures. There are two (2) sheets of drawings accompanying this application.

Reference is made to FIG. 1, which is a flow diagram composed of the process apparatus, elements which for the most part are conventional (except for the mixer hereafter described) and shows a preferred embodiment of an apparatus for a continuous batch method of processing.

DESCRIPTION OF THE PREFERRED EMBODIMENT

The preferred embodiment of the present invention is described. In some instances alternate means for holding, transferring, transporting and valving the fluids herein shall become obvious to those skilled in the art as the description is read.

Figure 1:
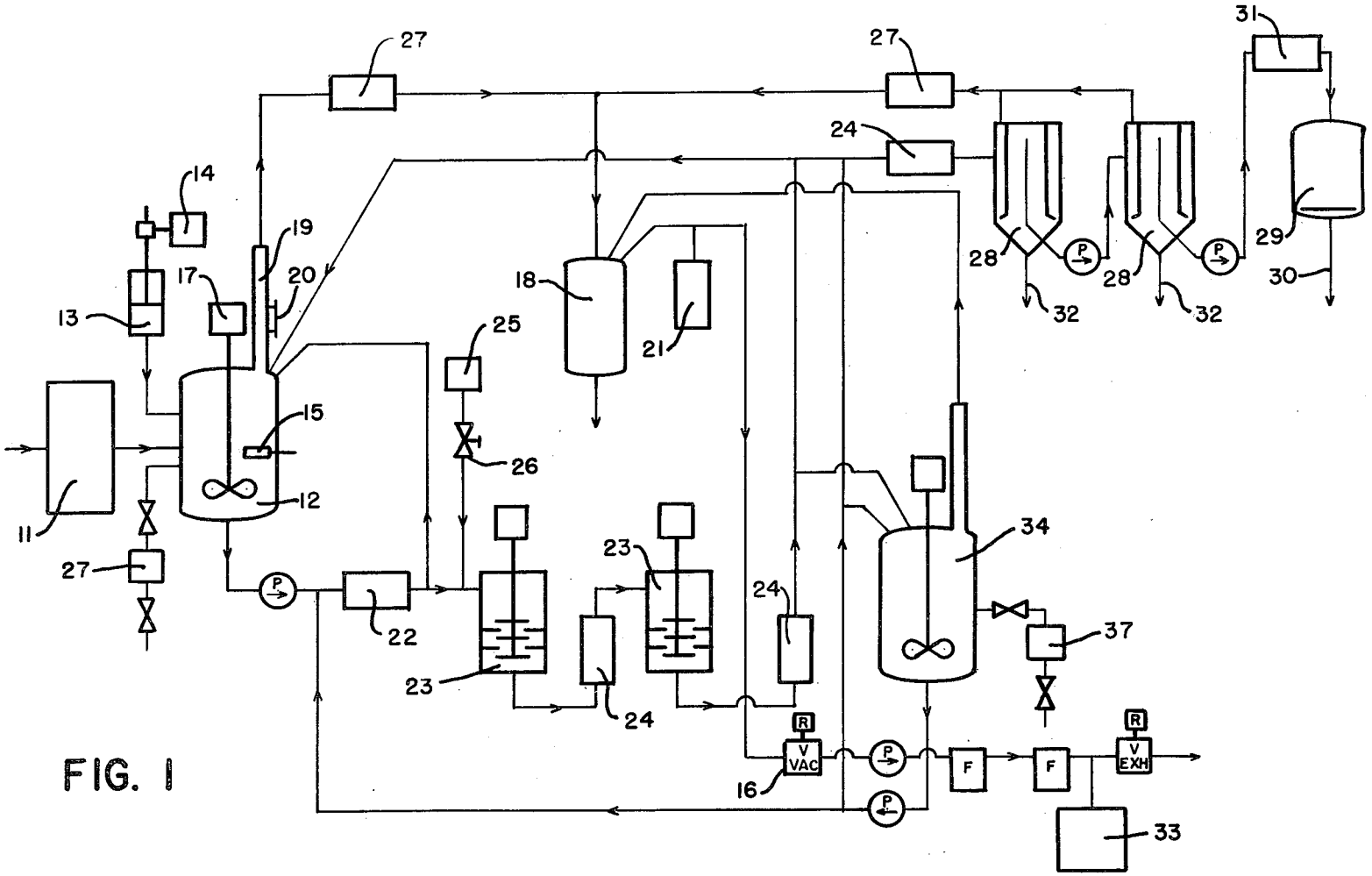

Referring now to FIG. 1, a quantity of PCB-contaminated oil is deposited in a holding tank [11] from which is removed by gravity a predetermined volume to a reaction vessel [12]. A vacuum is created in the space above the deposit, such that said space is purged of air. The temperature of the oil is raised by means of an immersion heater [15], to above 105° C. while the vessel atmosphere is evacuated to 27–29 inches of mercury, standing vacuum, by means of a vacuum pump [16] so that vacuum distillation will take place. Agitation is then commenced by stirring means [17] and circulation by pump means through heat exchanger [22] and spray means on re-entry into the reacting vessel to flash vaporize water. As the temperature, e.g., from 40° C. to 105° C., and the vacuum stabilize at the preferred levels, water, solvents, dissolved gases and unwanted light oil fractions are separated and distilled from the mixture and collected in a receiver [18]. The removal by vacuum distillation of substantially all of the water from the mixture is essential so as to prevent a reaction between water and the subsequently added liquid sodium, which reaction would completely inhibit the desired process and create an explosive hazard. The facilitation of the vacuum distillation of the water and the like is aided by the installation of a reflux tower [19] at the top of the reaction vessel. The vacuum is maintained at the stated level for a period of several minutes based upon the amount to be separated of water, solvents, light oil fractions and dissolved gases, contained in the oil. The completion of the distillation may be readily determined by examining the contents of the receiver [18] or by visual inspection through a sight glass [20] fitted into the tower.

When it is determined that the vacuum distillation products have been effectively removed, the vacuum is made nominal (2–3 inches of mercury, standing vacuum) and the atmosphere above the oil and throughout the apparatus is replaced so that it consists entirely of argon gas which is released from a pressurized storage tank [21] while the mixture temperature is permitted to rise to preferable 120° C.–130° C. Simultaneously therewith a predetermined, pre-heated, metered [13] quantity of liquid sodium is withdrawn from its storage cylinder [14], and mixed with the oil. Thereafter, the mixture is circulated by pump through electrically controlled heat exchangers [22], through specially designed, nondirectional mechanical mixing devices [23] and subjected to ultrasonic vibration by means of a transducer [24]. Prior to mechanical mixing, pressurized hydrogen gas [25] is entrained and dissolved [26]. The mixture is now circulated through a circulation sub-system which originates at the reaction vessel [12] passes through heat exchanger [22] to hydrogenation [25] then to mixer [23], and transducer [24] and back to the reaction vessel [12].

Recirculation continues for an interval time which is a function of the level of PCB's in the original deposit. A small quantity of mixture may be collected from time to time at a collecter [37] and removed for analysis by a Shimadzu Glass Column Electron Capture Detection gas chromatograph or the like.

If the diminished PCB level is found to be acceptable the mixture is then pumped on for final treatment to heat exchange coolers [27], multi-phase gravity separating means [28] and filter means [29] with the treated, PCB-free oil collected at a terminus [30]. The heat exchanger [31] located before the filtering means [29] may be used to increase or decrease the temperature of the mixture to aid in the separation and control of the precipition of solids from the oil. Waste products, mostly sodium chloride and unreacted sodium are collected at [32], with the argon gas removed at [33] to be re-used in purging the system of air as needed in the next batch.

If the reaction is not deemed to have reached a satisfactory end-point a second reaction vessel [34] is made available for further treatment, by diverting the unresolved mixture thereto. Simultaneously therewith, and without interference, a second quantity of oil may be deposited in the primary reaction vessel [12] to commence a further treatment cycle or to repeat the treatment of the original deposit if unsatisfactory. As may be seen a second batch may be started through the recirculation cycle described where the first batch is being purified.

In addition to the operating conditions described above it has been found that a typically contaminated liter of oil should be reacted with 0.01 grams of sodium per one ppm of PCB.

It has also been found that the mixing of the liquid sodium with the contaminated oil is enhanced, and the reaction resulting in the elimination of PCBs is significantly improved, by circulating the mixture through a mixing device [23] of a certain configuration. Your applicant has invented such a mixer whose novel and unique features, it is felt, are an important part of the process disclosed.

A preferred embodiment of the mixer is described in detail by reference to FIG. 2.

The mixer comprises a removable disc-shaped top member [101] having an upper face on which is centrally disposed a hub [102] which houses air tight bearings [103] attached to an upper portion of a downwardly directed rotable shaft [104]. The top member's lower face has formed therein an inverted cup [105] from the side of which is led an inlet passage [106] an entrance end of which is located centrally on a flange face [107] which is perpendicularly and integrally part of the top member and connects as an inlet to the circulation sub-system herein before described.

The lower face of the top member abuts sealingly [108] by means of quick disconnects [109] to an upper circular flange [110] which perpendicularly and integrally forms an upper end of a vertically disposed cylinder [111] so as to form a chamber into which project a multiplicity of radially, inwardly, integrally formed fours a stator shearing fingers [112] spaced planarly 90° apart in spaced tiers somewhat more than the thickness of a stator finger apart along the vertical axis of the cylinder.

The cylinder has a bottom end on which is intergrally formed a circular flange [113] having a face perpendicular to the vertical axis of the cylinder in which is recessed an outlet passage [114] said face abutting sealingly [115] on an upper face of an annular plate [116] which has thereon a central annular hub [117] which houses airtight bearings which are attached to a lower end of the downwardly directed rotable shaft.

The downwardly directed rotable shaft has projecting therefrom a multiplicity of radially, outwardly, integrally formed pairs of rotor shearing fingers [118] spaced planarly 180° apart in spaced tiers somewhat more than the thickness of a rotor shearing finger apart along the vertical axis of the shaft such that when the shaft is set in the airtight bearings of the annular hub, the shaft may freely rotate in close clearance without impedement by the stator fingers of the rotor fingers.

The annular plate has a lower face which abuts sealingly [119] by means of quick disconnects [109] on an upper face of a first flange [120] of a flanged 90° elbow exit means [121], such that the chamber is fully enclosed. The second flange [122] of the flanged exit means is connected to the circulating sub-system as herein before described.

When the chamber is filled with circulating oil and liquid sodium and the rotor is caused to turn typically at 1750 rpm, violent shearing forces are set up and any liquid sodium which has golburlarized or is otherwise ineffectively dispersed in the oil is rapidly broken down into microscopically small particles and homogenized with the oil thereby facilitating the reaction. Setting the rotor fingers at 90° to the axis of rotation without angularity or pitch ensures that the circulation rate of the reactants is regulated by the rate of delivery of only the pump. Surprisingly, this regulation has an enhancing effect on the reaction time to completion from a given starting point level of PCBs.

Figures 2, 3:
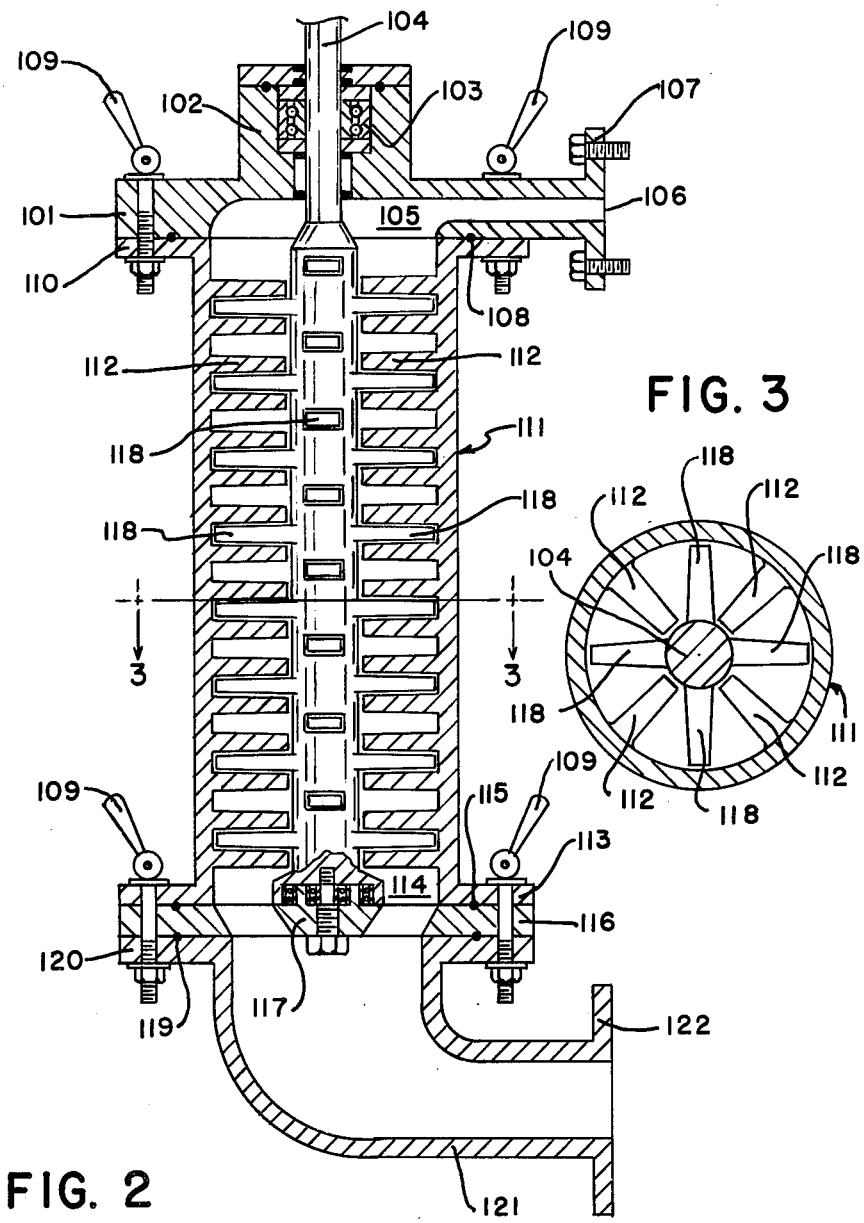
FIG. 2, shows in cross-section detail the design and function of the mixer which is preferrably used in the process.
FIG. 3 is a view taken along the line 3—3 of FIG. 2.

Reference is made to FIG. 3, which shows a sectional view of the mixer when the top member is removed and the rotor shaft [104] is rotated so that the rotor fingers [118] are 45° opposed to the stators [112]. In this position the rotor shaft may be readily removed for maintenance and inspection.

While the preferred embodiment of both the process apparatus and the mixer have been shown and described various modifications and substitutions maybe made thereto without departing from the spirit and the scope of the invention. Thus, by way of example only, the step of ultrasonic vibration may be replaced or augmented by high frequency mechanical vibration. Accordingly it is to be understood that the present invention has been described by way of illustration and not limitation.

What is claimed is:

1. A method for eliminating polychlorinated bi-phenyls from polychlorinated bi-phenyl containing hydrocarbonaceous oil which comprises:

(a) Depositing a measured weight of hydrocarbonaceous oil in a reacting vessel;

(b) Causing a vacuum to exist in the reacting vessel by evacuating air therefrom;

(c) Raising the temperature of the oil and vacuum distilling the same to remove substantially all water, solvents and light fraction oils therein contained;

(d) Releasing the vacuum to near ambient atmospheric pressure while simultaneously adding an inert gas thereto to form an atmosphere above the mixture such that air is excluded;

(e) Adding to the reacting vessel an amount of liquid sodium to the oil sufficient to eliminate the polychlorinated bi-phenyls to EPA acceptable levels;

(f) Raising the temperature of the oil to a point which maintains the sodium in liquid condition;

(g) Agitating the oil and the sodium to form a mixture thereof;

(h) Circulating the oil from the reacting vessel through:

(1) Heat exchangers and then (2) A mixing means and then (3) A vibratory means and then (4) Returning the mixture to the reacting vessel;

(i) Reacting the oil and the sodium until the polychlorinated bi-phenyl content is reduced below EPA minimum requirement therefor;

(j) Cooling the mixture;

(k) Separating the reacted oil from other reactants;

(l) Filtering and purifying the reacted oil.

2. As in claim 1, by adding after (h) (2) thereof, the step of dissolving hydrogen gas in the mixture.

3. As in claim 2, dissolving an amount of hydrogen gas in the oil sufficient to saturate the oil with hydrogen.

4. As in claim 1, at (e) thereof adding an amount of liquid sodium to the oil in a ratio of 0.01 grams of sodium for each part per million of polychlorinated biphenyl per liter.

5. As in claim 1, at (b) thereof, evacuating the air until the vacuum stands at 25 to 29 inches of mercury.

6. As in claim 1, at (c) thereof, raising the temperature of the oil to 105°–130° C.

7. As in claim 1, at (d) thereof, releasing the vacuum, until it stands at 2–5 inches of mercury.

8. As in claim 1, at (d) thereof in which the inert gas is chosen from a group consisting of helium, argon, krypton or neon.

9. As in claim 8, where the gas is argon.

10. As in claim 1, at (i) thereof reducing to where the polychlorinated bi-phenyl content is below 2 ppm.

11. As in claim 1, at (h) (2) thereof mixing the oil and the liquid sodium in a non-directional mixer.

12. As in claim 11 said mixer being an enclosed, sealed airtight mixer comprising:

(a) An inlet means having a cup shaped lower face for admitting the oil and sodium mixture into (b) A flanged, vertically disposed cylinder with a first flange perpendicularly disposed to an upper end of the cylinder such that it mates sealingly with the lower face of the inlet means and forms a chamber with the interior of the cylinder into which chamber project integrally formed, radially inwardly (c) Stator shearing fingers means spaced in fours planarly apart 90° and arranged in tiers spaced somewhat more than a shearing finger thickness apart along the vertical axis of the cylinder;

(d) A lower end of the cylinder having a second flange perpendicularly disposed thereto which flange abuts sealingly on an annular plate having an upper face which has disposed thereon centrally an annular hub which receives a lower end of a rotor shaft centrally, vertically disposed in the chamber which rotor shaft has an upper end leading outward through a top of the inlet means;

(e) The rotor shaft has disposed thereon rotor shearing finger means spaced in pairs planarly apart 180° and arranged in tiers spaced somewhat more than a shearing finger thickness apart along the vertical axis of the rotor shaft such that when the rotor shaft is rotated the rotor fingers closely clear the stator fingers and are not impeded by them and such that any oil and sodium mixture contained in the chamber is subjected to substantial shearing forces imparted by the rotor and stator fingers which forces substantially reduce the particle size of the liquid sodium homogenize the mixture;

(f) Sealing attached to a bottom face of the annular plate is a first flange of a flanged exit means through which passes the homogenized oil and sodium mixture and past a second perpendicularly disposed flange sealingly connected to the circulating system.

13. As in claim 1, where the hydrocarbonaceous oil is transformer oil.

* * * * *